US010823539B1

(12) United States Patent
Oberholster et al.

(10) Patent No.: US 10,823,539 B1
(45) Date of Patent: Nov. 3, 2020

(54) EXPANDING SUBSONIC BULLET

(71) Applicants: SME Engineering (PTY) LTD, Pretoria (ZA); Apex Munitions, LLC, Plainfield, NH (US)

(72) Inventors: Alliwyn J. Oberholster, Pretoria (ZA); David B. Stark, Plainfield, NH (US)

( * ) Notice: Subject to any disclaimer, the term of this patent is extended or adjusted under 35 U.S.C. 154(b) by 0 days.

(21) Appl. No.: 16/181,417

(22) Filed: Nov. 6, 2018

Related U.S. Application Data

(60) Provisional application No. 62/586,111, filed on Nov. 14, 2017.

(51) Int. Cl.
*F42B 12/34* (2006.01)

(52) U.S. Cl.
CPC ..... *F42B 12/34* (2013.01)

(58) Field of Classification Search
CPC ..... F42B 12/34
USPC ..... 102/507–510
See application file for complete search history.

(56) References Cited

U.S. PATENT DOCUMENTS 1,767,308 A * 6/1930 Phillips ..... F42B 12/78 102/507
4,655,140 A * 4/1987 Schirneker ..... F42B 10/22 102/508
6,776,101 B1 * 8/2004 Pickard ..... F42B 12/34 102/507
6,845,717 B1 * 1/2005 Sauvestre ..... F42B 12/34 102/518
7,681,504 B2 * 3/2010 Machina ..... F42B 10/06 102/506
7,814,837 B2 10/2010 Sauvestre
8,171,852 B1 5/2012 Rebar
8,186,277 B1 * 5/2012 King ..... F42B 12/34 102/507
8,307,768 B2 * 11/2012 Cziglenyi ..... F42B 30/02 102/517
D734,419 S * 7/2015 Burczynski ..... D22/115
9,316,468 B2 4/2016 Rall et al.
9,631,910 B2 4/2017 Fricke
10,072,914 B2 * 9/2018 Flint ..... F42B 12/367
2005/0241523 A1 * 11/2005 Schikora ..... F42B 12/34 102/510
2007/0193468 A1 * 8/2007 Sauvestre ..... F42B 30/02 102/501

* cited by examiner

*Primary Examiner* — John Cooper
(74) *Attorney, Agent, or Firm* — Jeffrey E. Semprebon

(57) ABSTRACT

A bullet designed to expand reliably at subsonic velocities has a leading end region divided by notches into petals. The exterior of the bullet has a groove configured to allow limited initial bending of the petals to facilitate spreading of the petals to increase the cross-section of the bullet upon impact with a target.

19 Claims, 10 Drawing Sheets

EXPANDING SUBSONIC BULLET

FIELD OF THE INVENTION

The present invention relates to a bullet designed to expand reliably when it hits a target at subsonic or transonic velocities.

BACKGROUND

Expanding bullets which deform to an increased cross-section upon impact with a target are preferred in many situations, as the increased cross-section enhances the effectiveness of the bullet by increasing its ability to transfer kinetic energy to the target. However, reliable expansion has been found problematic for bullets fired at relatively low velocities, as the dynamic forces that may be employed to cause expansion are correspondingly lower. This is a particular concern for bullets designed for suppressed firearms, as the velocity of such bullets is limited by the desire to avoid velocities which are sufficient to break the sound barrier, which would greatly reduce the effectiveness of suppressing the sound of the gunshot.

One attempt to provide reliable expansion of a bullet at subsonic velocities employs a bullet with slots that separate a leading region of the bullet into an array of "petals", in combination with a ram element in a cavity in the leading end of the bullet, as taught in U.S. Pat. No. 9,631,910 of Lehigh Defense, LLC, and incorporated herein by reference. In this design, the ram element is forced rearward when the bullet impacts the target, and this rearward motion acts to spread the petals apart to increase the cross-section of the bullet.

SUMMARY

The bullets disclosed herein are designed to provide more reliable expansion than has previously been available bullets when fired at subsonic and transonic velocities. Like some previous expanding bullets, the bullet has an elongated body with a leading end region having a cavity, and the leading end region is divided into a number of "petals" separated by radially-extending longitudinal notches or slots. Upon impact with a target, hydraulic forces act to splay the petals apart, increasing the cross-section of the bullet to aid in transferring its kinetic energy into the target.

The bullets disclosed herein employ segmented petals to provide more reliable spreading apart under hydraulic forces. This is achieved by use of a groove in each petal that divides the petal between a petal forward section and a petal base section. The petal forward section extends forward from the groove to terminate at a forward face of the body, which may include inwardly-sloping surfaces to enhance the hydraulic forces acting to separate the petals. The petal base section extends rearward from the groove to the ends of the notches, where it is integral with the remainder of the body.

The groove between the petal forward section and the petal base section creates a line of reduced strength, and acts as a living hinge that allows the petal forward section to bend relative to the petal base section under hydraulic forces. Thus, when the bullet first impacts the target, the petal forward sections begin to splay outwards before the petal base sections, bending outwards at an angle to the petal base sections. When the petal forward sections have bent outwards to a desired degree, the groove is configured so as to bring an edge where the groove terminates at the forward region exterior surface into engagement with a surface of the groove, this engagement serving to block further bending of the petal forward section along the line of weakness provide by the groove. For typical bullet profiles, a petal forward section rear edge can engage a rear surface of the groove to limit the bending. At the point where further bending of the petal forward section is so blocked, an inner surface of the petal forward section (which defines a portion of the cavity prior to bending) is angled outwards, and acts as a ramp surface against which hydraulic forces are applied as the bullet continues to move through the target. Due to the increased surface area and angle, the hydraulic forces acting on the petal forward inner surface are significantly greater than those initially acting on the bullet, and serve to reliably force the petal base sections to splay apart, greatly increasing the cross-section of the bullet.

The longitudinal notches that separate the petals may be formed perpendicular to the exterior surface, and project along a line that intersects the central axis of the bullet to form petals that are symmetrical in cross-section. However, depending on the desired performance of the bullet, the notches may be formed at an angle other than 90° to the outer surface of the bullet and/or not along a line that intersects the central axis; in such cases, the petals have an asymmetrical cross section having one edge that is blunter than the other. When these petals engage the target medium, the rotation of the bullet results in either a blunter or sharper leading edge of each petal rotating into the target medium, depending on the angle selected for the notches and the twist direction of the barrel through which the bullet is fired (typically a right-hand twist). If the angle is selected relative to the twist direction such that a more blunt leading edge is presented as the bullet rotates through the target medium, it should enhance the ability to rapidly transfer rotational kinetic energy of the bullet into the target medium, causing a larger wound channel, but at the expense of greater resistance which may limit penetration. The enhanced transfer of rotational energy may be advantageous for applications where the rotational kinetic energy is a relatively large component of total energy of the bullet, such as when fired through firearm barrels having an extremely fast twist rate. In contrast, if the angle is selected so as to present a sharper leading edge, the reduced resistance compared to a symmetrical or blunt leading edge may allow for greater penetration, at the expense of reduced ability to quickly transfer rotational kinetic energy to the target medium.

One concern that has been found is that bullets with grooves as described above which employ conventional overall profiles may be limited in the ability of the petal forward sections to spread reliably at higher velocities. When bullets having a conventional overall profile are fired at relatively high velocities (greater than 900 fps/275 m/s), the petal forward section frequently fails to spread; this is believed to be due to the tapered profile of the petal forward section creating hydraulic forces directed inward, counter-acting pressure forces in the cavity that would otherwise spread the petal forward sections apart. Applicants have found that this problem at higher velocities can be overcome by forming the exterior contour of the forward sections of the petals such that they provide a pressure-reducing section forward of the groove.

The pressure-reducing section is configured to reduce inwards pressure compared to a conventional ogive profile, so as to reduce or eliminate inward forces that impede spreading of the petal forward sections. In some cases, the profile may generate a low-pressure region surrounding a portion of the petal forward section. Either or both of these effects facilitates the outward bending of the petal forward section under the influence of increased pressure in the cavity as the bullet moves through the target medium, and thus provides more reliable operation at higher velocities. In typical examples, the angle of the outer surface of the petal forward section to the central axis of the bullet is reduced relative to the rest of the ogive of the bullet. One way to give effect to this is to remove or omit part of the normal ogive volume from the outer surface of the petal forward section. The drag and/or friction of the outer surface of the petal forward section, and therefore the inward forces, is reduced when the bullet travels through the target. The balance between the inward folding forces and outward folding forces can be manipulated by adjusting the profile of the exterior surface of the petal forward section to suit the desired range of velocities at which the bullet is expected to perform. Bullets with such pressure-reducing sections where the outer surface is essentially parallel to the central axis have been found to operate successfully at higher velocities, at least up to about 1050 fps (~320 m/s).

Further reliability in opening can be provided by forming the leading face of the bullet with a rearward-sloping surface that acts as a ramp or funnel to apply outward forces on the petal forward sections as the leading face moves through the target medium. Additionally, the cavity may have be configured to reduce the thickness of the petal forward sections to make them easier to bend, while retaining a greater thickness of the petal base sections to aid in retaining them with the remainder of the bullet, rather than breaking off.

BRIEF DESCRIPTION OF THE FIGURES

FIG. 3A shows the petal prior to impact. FIG. 3B shows the petal immediately after impact, when hydraulic forces acting on the petal forward section have caused it to start bending at an angle to the petal base section, with the groove acting as a living hinge. FIG. 3C shows the petal when the petal forward section has bent sufficiently to bring a petal forward section rear edge into abutment against a groove rear surface, blocking further bending action at the groove; at this position, the petal forward section acts as a ramp, creating additional outwardly-directed hydraulic forces as the bullet continues through the target. FIG. 3D shows the petal opening further as the bullet continues through the target. Since further bending at the groove is blocked, further spreading under hydraulic forces bends the petal base section outwards; these hydraulic forces are increased by the additional surface area of the petal forward section. FIGS. 3E and 3F show further bending of the petal base section as the bullet continues through the target, the outward spread of the petal base section significantly increasing the cross-section of the bullet and providing more effective transfer of kinetic energy to the target.

FIG. 9 illustrates a bullet such as shown in FIG. 4, where the notches that separate the petals extend radially outwards and intersect the longitudinal axis, while FIGS. 10 and 11 illustrate alternative bullets where the petals are separated by slots that do not extend radially straight outwards, but rather extend at an angle such that projections of the slots do not intersect a central longitudinal axis of the bullet.

DETAILED DESCRIPTION

Figure 1:
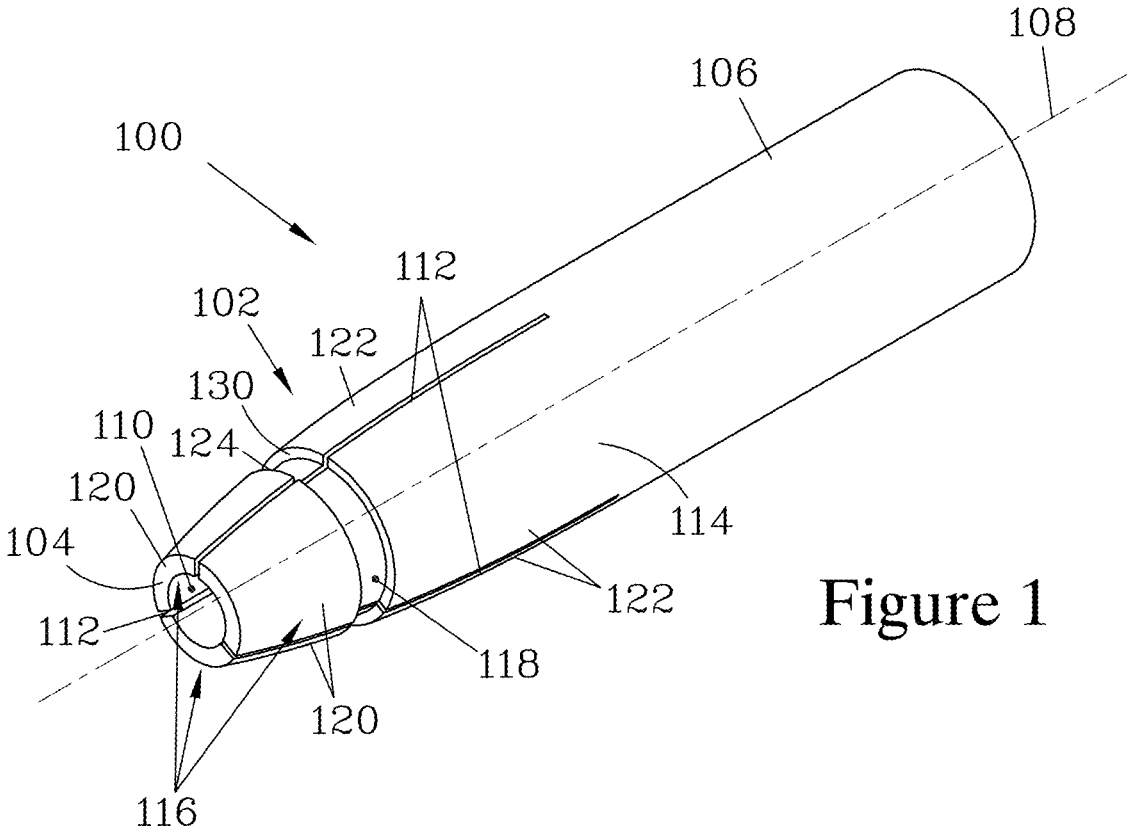
FIGS. 1 and 2 are an isometric views illustrating a bullet prior to being fired into a target, with FIG. 2 being sectioned to show details of the interior. The bullet shown in FIGS. 1 and 2 has a conventional exterior profile, with the exception of an array of radially-extending slots, which separate a leading end region into a number of petals, and a groove which divides each petal between a petal forward section and a petal base section. The groove serves as a living hinge between the petal sections, allowing the petal forward section to bend up to a set angle with respect to the petal base section; the groove is further configured to arrest further bending beyond the desired degree, as illustrated in FIGS. 3A-3F.
Figure 2:
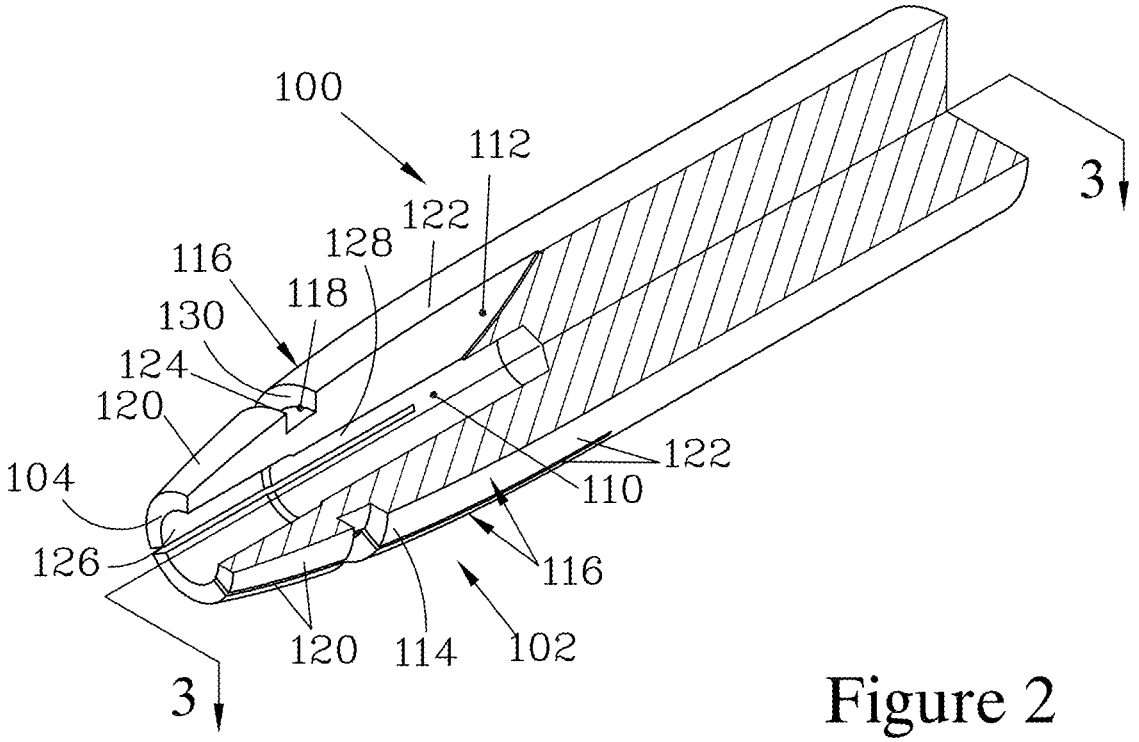

FIGS. 1-3F illustrate a bullet 100 that is generally formed as an elongated body having a body leading end region 102 that terminates at a leading face 104, and having a body trailing end region 106. The body 100 has a central longitudinal axis 108. A cavity 110 is formed in the leading end region 102, terminating at the leading face 104 and extending therefrom rearward towards the body trailing end region 106.

The leading end region 102 has three longitudinal notches 112 that extend radially between the cavity 110 and a leading region exterior surface 114, such that the notches 112 divide the leading end region 102 into three petals 116. While three notches and petals are employed in this embodiment, it should be appreciated that a greater number of notches and petals may be employed depending on the overall configuration and/or composition of the bullet, in order to optimize results for particular chamberings and intended uses.

The leading region exterior surface 114 is interrupted by a groove 118 that traverses each of the petals 116, and which divides each petal 116 between a petal forward section 120 and a petal base section 122. The petal forward section extends from the groove 118 to the leading face 104, and has a petal forward section rear edge 124 where the groove 118 intersects the leading region exterior surface 114. The petal forward section 120 has a petal forward inner surface 126, which defines a portion of the cavity 110. The petal base section 122 extends rearward from the groove 118 along the extent of the notches 112 and joins to the remainder of the body 100. The petal base section 122 again has a petal base inner surface 128, which defines a portion of the cavity 110. The groove 118 has a groove rear surface 130 that terminates at the leading region exterior surface 114.

Figure 3A:
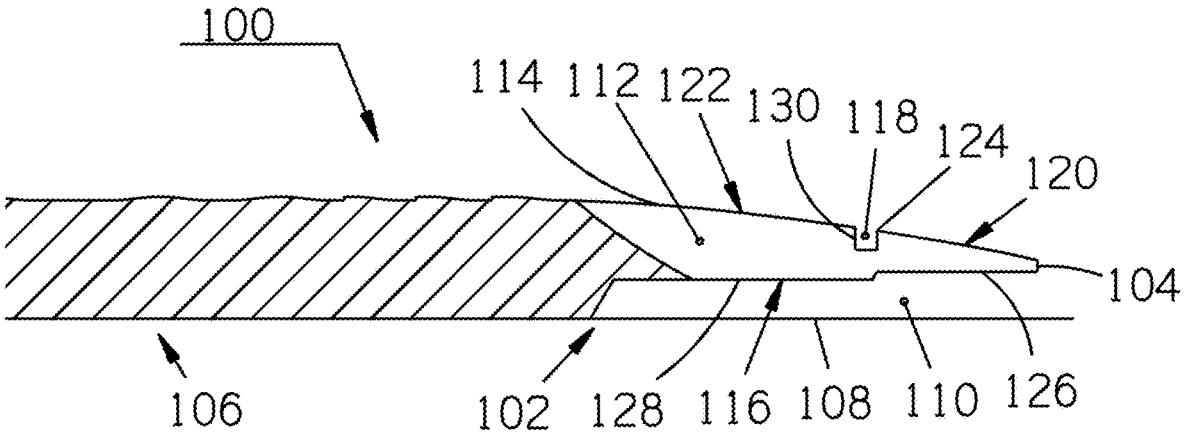
FIGS. 3A-3F show a series of partial section views illustrating the action of one of the petals of the bullet shown in FIGS. 1 and 2 when the bullet impacts a target and is subject to hydraulic forces.

FIGS. 3A-3F illustrate the action of one of the petals 116 when the bullet impacts a target composed of a wet medium, such as ballistic gelatin or the body tissue of an animal. FIG. 3A illustrates the bullet 100 prior to impact (as in FIGS. 1 and 2), where the petal 116 has not yet been subjected to hydraulic forces.

Figure 3B:
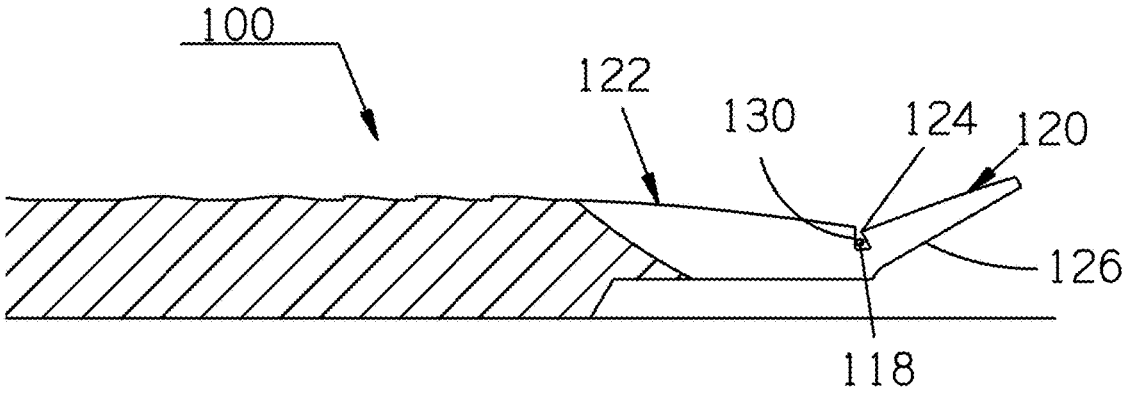
Figure 3C:
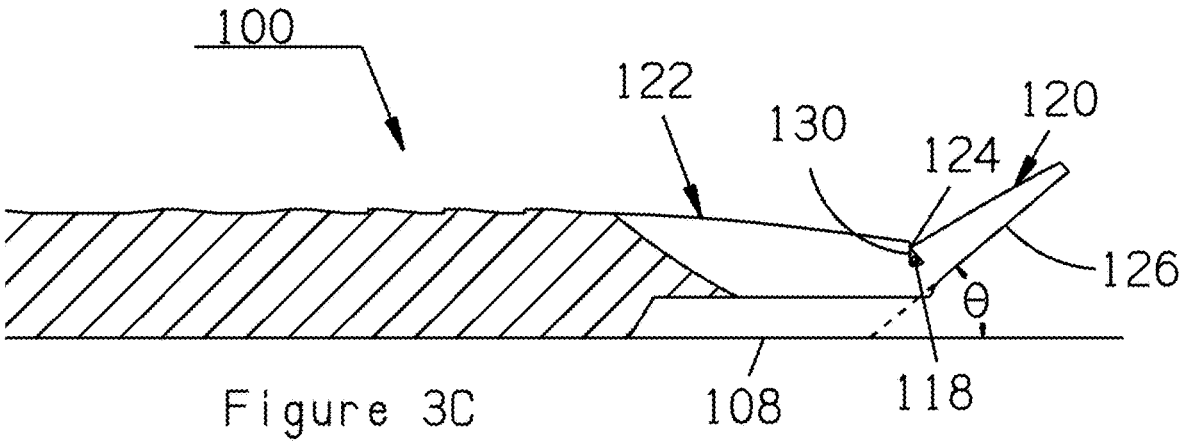

FIG. 3B shows the bullet 100 immediately after impact, when increasing pressure in the cavity 110 caused by hydraulic forces has exerted a radially-outward force on the petal 116. Because the groove 118 creates a region of reduced cross-section that acts as a living hinge, such forces initially cause the petal forward section 120 to bend outwards. This outward bending exposes the petal forward inner surface 126 to additional hydraulic forces as the bullet 100 moves through the target, resulting in further bending of the petal forward section 120. The bending of the petal forward section 120 continues until it has bent sufficiently to bring the petal forward section rear edge 124 into engagement with the groove rear surface 130, as shown in FIG. 3C. It should be noted that, depending on the overall profile of the bullet and the configuration of the groove, alternative surfaces may be brought into contact to "close" the groove and block further outward bending of the petal forward section.

Figure 3D:
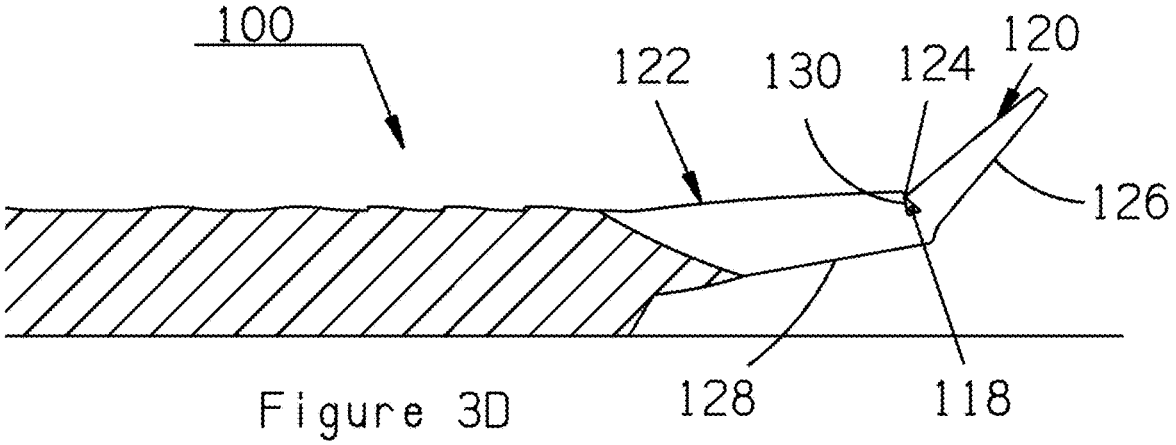
Figure 3E:
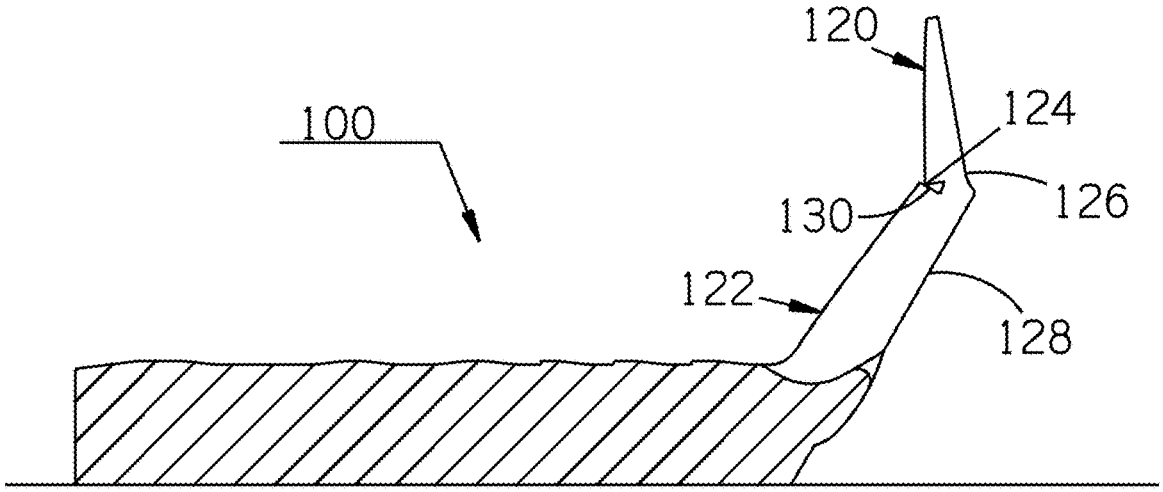
Figure 3F:
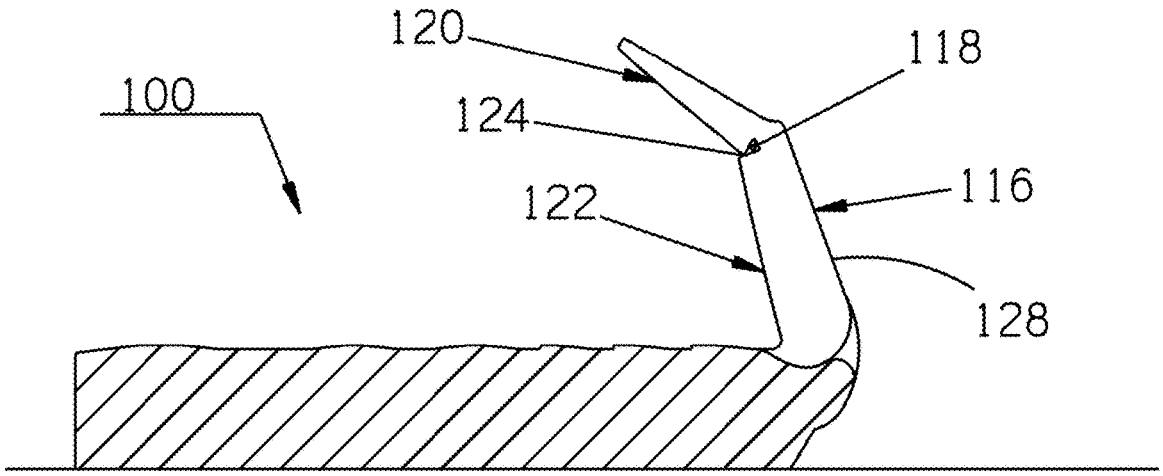

At the point shown in FIG. 3C, the engagement of the petal forward section rear edge 124 with the groove rear surface 130 blocks further bending action of the living hinge created by the groove 118. The petal forward inner surface 126 is inclined with respect to the longitudinal axis 108 by an angle Θ. In preliminary testing, blocking further bending when the angle Θ was about 30° was found to be effective for 0.300 Blackout bullets. When the petal forward inner surface 126 is blocked in its inclined position by "closure" of the groove 118, it acts as a ramp surface exposed to hydraulic forces; as the bullet 100 continues through the target, the forces on the petal forward inner surface 126 acts to apply outwardly-directed hydraulic forces on the entire petal 116, since these forces can no longer be accommodated by bending of the petal forward section 120 relative to the petal base section 122. FIGS. 3D-3F illustrate the outward bending of the petal base section 122 under the influence of the hydraulic forces as the bullet 100 continues through the target. The initial bending of the petal forward section 120 to an angled position at which it exerts increased outward forces to promote bending of the entire petal 116 allows the bullet 100 to achieve reliable expansion at subsonic velocities.

Preliminary testing of bullets formed from solid copper with a configuration according to the bullet 100 shown in FIGS. 1-3F in 0.300 Blackout has found the performance of this configuration to be limited to velocities below about 900 fps (~125 M/S). It is believed that hydraulic forces on the leading region exterior surface 114 create excessive inward forces on the petal forward sections 120 that impairs their ability to operate as intended at higher velocities.

Figure 4:
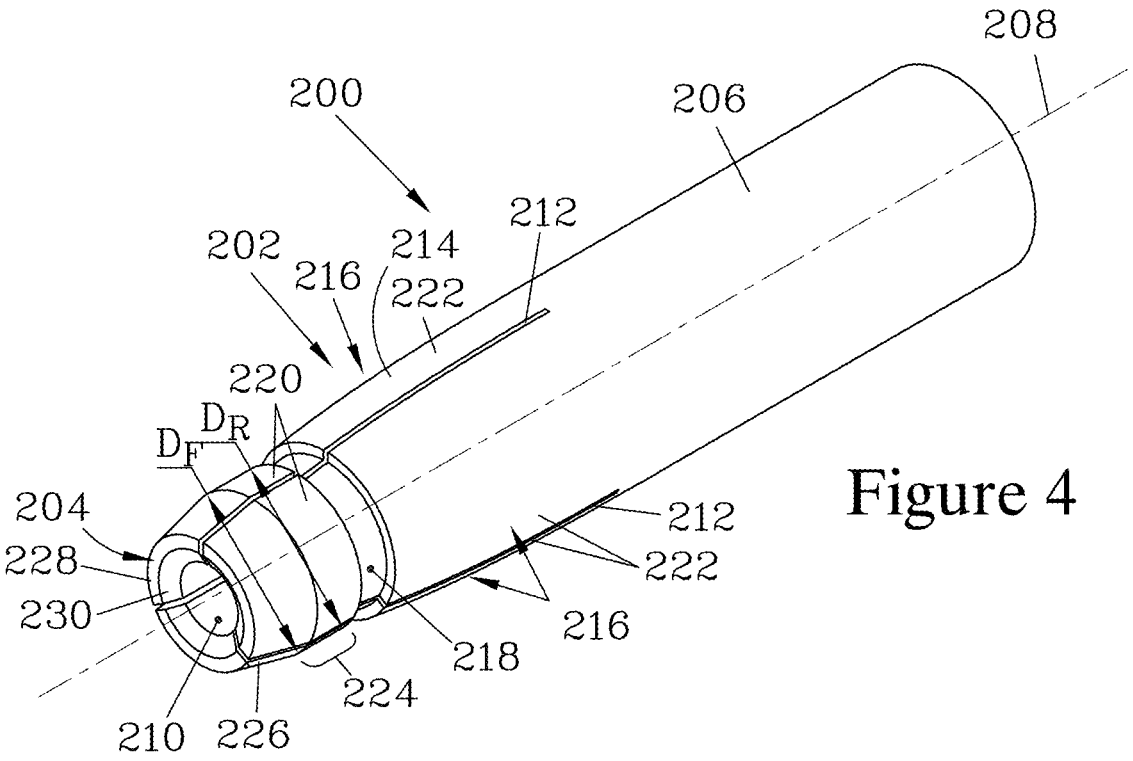
FIG. 4 is an isometric view that illustrates a bullet that is similar to the bullet shown in FIGS. 1 and 2, but which employs a pressure-reducing section in the exterior profile of the petal forward sections extending forward from the groove; the pressure-reducing section of this embodiment is cylindrical, having a pressure section forward diameter and a pressure section rear diameter at the groove where the diameters are equal. This bullet also has a leading face that has a rearward-sloping portion to create a funnel leading into the cavity, further aiding in reliable spreading of the petal forward sections.

FIG. 4 illustrates a bullet that is designed to overcome the velocity limitations of the bullet 100 discussed above. The bullet 200 is again formed as an elongated body 200 with a body leading end region 202, terminating at a leading face 204, and a body trailing end region 206, and having a central longitudinal axis 208. A cavity 220 is again formed in the leading end region 202, and three notches 212 extend between the cavity 220 and a leading region exterior surface 214 to define three petals 216. Each petal 116 is divided by a groove 218 into a petal forward section 220 and a petal base section 222.

In the bullet 200, the leading region exterior surface 214 does not follow a conventional bullet profile, but instead is formed with a pressure-reducing section 224 that extends forward from the groove 218. The pressure-reducing section 224 of this embodiment is cylindrical, having a pressure section front diameter $D_F$, where the pressure-reducing section 224 joins a tapered section 226, that is equal to as pressure section rear diameter $D_R$, where the pressure-reducing section 224 terminates at the groove 218. The tapered section 226, which may be ogive or frustoconical, extends forward from the pressure-reducing section 224 and terminates at the leading face 204.

Because the leading region exterior surface 214 is parallel to the longitudinal axis 208 in the cylindrical pressure-reducing section 224, inwardly-directed hydraulic forces on the petal forward section 220 are greatly reduced. While the pressure-reducing section 224 illustrated is defined by outer surfaces that are parallel to the longitudinal axis 208, for some applications it may be practical to employ exterior configurations for the pressure-reducing section that are not cylindrical. Examples are sections that are nearly cylindrical, defined by surfaces that are within a small angle of being parallel to the longitudinal axis, or sections which form a reverse taper, sloping inwards towards the groove, such as shown in FIGS. 7 and 13-15.

As a result of including the pressure-reducing section 224, the leading face 204 of the bullet 200 is significantly broader than the leading face 104 of the bullet 100. The leading face 204 of this embodiment is formed with a leading face outer region 228, which is planar and perpendicular to the longitudinal axis 208 and joins to the leading region exterior surface 214, and a rearward-sloping leading face inner region 230 which is inclined with respect to the longitudinal axis 208 and joins to the cavity 210. The leading face inner region 230 slopes toward the body trailing end region 206 as it progresses inward to the cavity 210, so as to form a funnel shape. When the bullet 200 moves through the target medium, force on the rearward-sloping leading face inner region 230 applies a radially outward force on the petal forward sections 220 to urge them outwards for more reliable spreading.

In preliminary testing, 0.300 Blackout bullets of solid copper having a configuration according to FIG. 4, with the tapered section 226 being somewhat longer than the cylindrical section 224, were found to provide more reliable expansion at higher velocities compared to bullets such as shown in FIGS. 1-3F. These bullets were also found to remain intact at velocities up to about 1050 fps (~320 m/s) when fired from barrels having a conventional twist rate of 1 in 8". However, some firearms having short barrels employ a faster twist rate, such as 1 in 5", and the forward sections of the petals of this bullet design were prone to breaking off when fired through barrels having such faster twist. It should be noted that, due to the more blunt overall profile provided by the pressure-reducing section and the resulting wider leading face, this bullet was not as reliable as desired in semi-automatic firearms when loaded into magazines intended for use with 5.56×45 mm ammunition, rather than magazines designed specifically for use with 0.300 Blackout ammunition.

Figure 5:
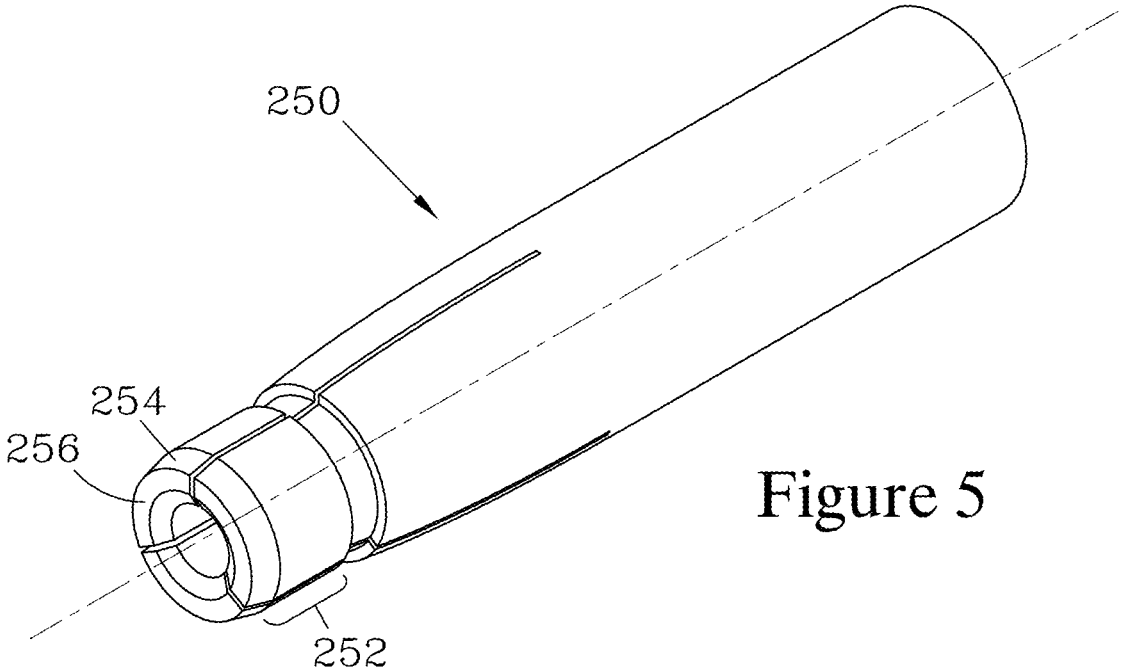
FIG. 5 is an isometric view of a bullet similar to that shown in FIG. 4, but where the cylindrical pressure-reducing section is longer.

FIG. 5 illustrates a bullet 250 that is similar to the bullet 200 shown in FIG. 4, but which has a cylindrical section 252 that is substantially longer than a tapered section 254 that terminates at a leading face 256. This results in the leading face 256 being significantly broader compared to the leading face 204. In preliminary testing, the bullet 250 with the elongated cylindrical section 252 was found to remain intact even when fired through barrels having a twist rate as fast as 1 in 5", while again having reliable spreading at velocities up to about 1050 fps (~320 m/s).

Figure 6:
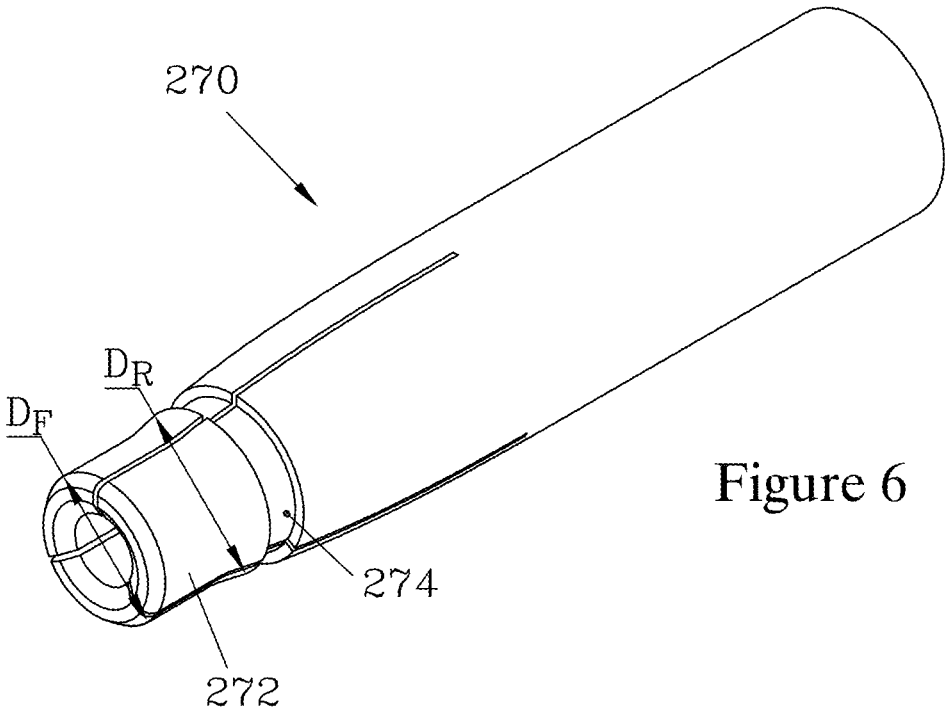
FIG. 6 is an isometric view of another bullet having a cylindrical pressure-reducing section; however, in this embodiment the pressure-reducing section includes flared section where it intersects the groove.
Figure 7:
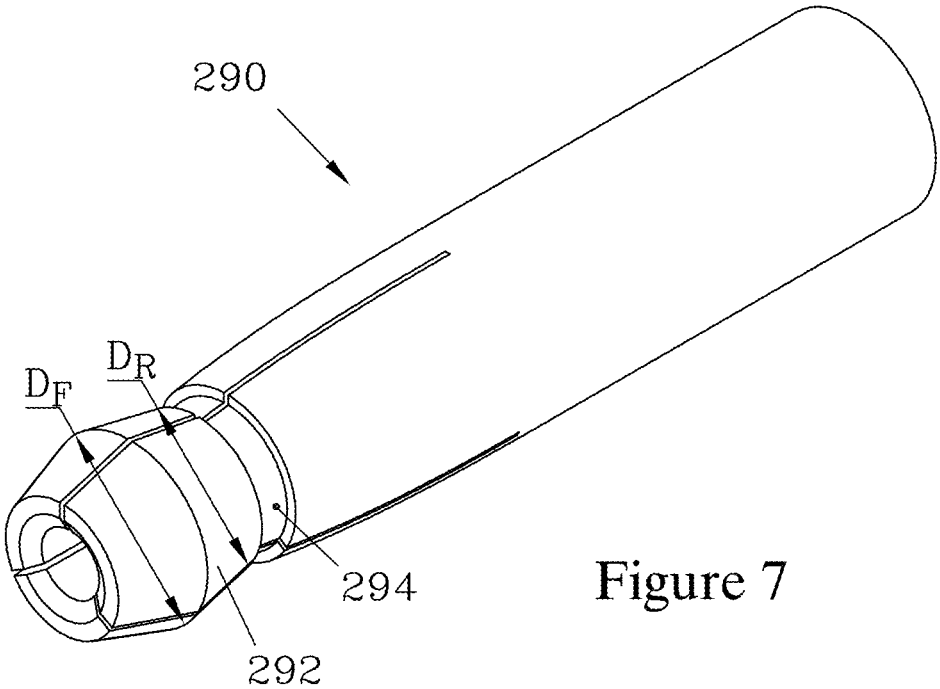
FIG. 7 is an isometric view of one example of a bullet that has a pressure-reducing section formed with a reverse taper, such that a pressure section forward diameter is greater than a pressure section rear diameter at the groove.

FIGS. 6 and 7 show further configurations that could be employed. Additional possible configurations are shown in FIGS. 12-18, discussed below. FIG. 6 illustrates a bullet 270 having a flared cylindrical profile for a pressure-reducing section 272. The pressure reducing section 272 has a constant diameter, equal to the pressure section front diameter $D_F$, along most of its length, and then expands in a flare profile to a slightly enlarged pressure section rear diameter $D_R$ adjacent to a groove 274. FIG. 7 shows a bullet 290 having a pressure-reducing section 292 with a reverse taper, where a pressure section front diameter $D_F$ is greater than a pressure section rear diameter $D_R$ adjacent to a groove 294.

Figure 8:
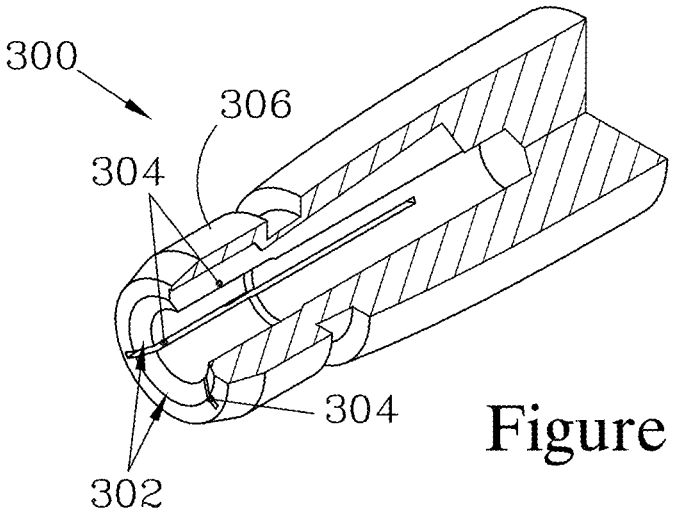
FIG. 8 is a partial isometric view showing a portion of a bullet similar to that shown in FIG. 4, but having an alternative leading end region structure, where the petals are defined by notches that do not extend to the exterior surface so as to form complete slots.

While bullet configurations such as shown in FIGS. 1-5, formed from solid copper and employing three petals divided by directly radially-outward-extending notches, were found effective for 0.300 Blackout cartridges at the velocities and barrel twist rates indicated, it should be appreciated that details of the bullet configuration, construction, and composition may be altered to suit different uses. FIGS. 8-11 illustrate some possible variations in the formation of the notches that separate the petals. FIG. 8 illustrates a bullet 300 where three petals 302 are defined by notches 304 that do not extend to a leading region exterior surface 306, and thus do not form complete slots; this configuration may be preferable in some situations when more malleable materials than copper are employed.

Figure 9:
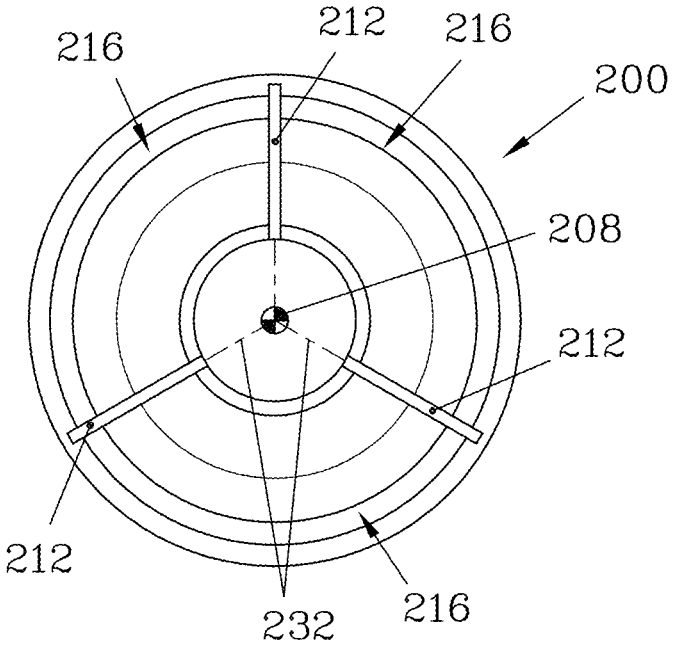
FIGS. 9, 10, and 11 are front views showing various configurations of slots that can be employed for bullets as disclosed herein.

FIG. 9 is a front view of the bullet 200 shown in FIG. 4, illustrating that the notches 212 that separate the petals 216 extend straight radially outwards, and thus projections 232 of the notches 212 intersect the longitudinal axis 208. This results in a symmetrical profile for the petals 216. However, in some situations it may be preferred for the petals 216 to be asymmetrical, as discussed below.

Figure 10:
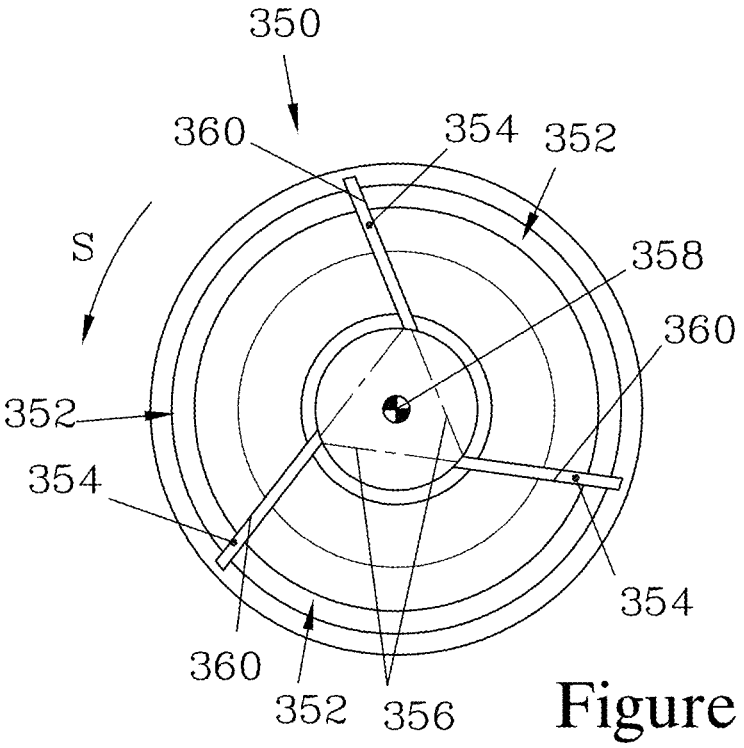
Figure 11:
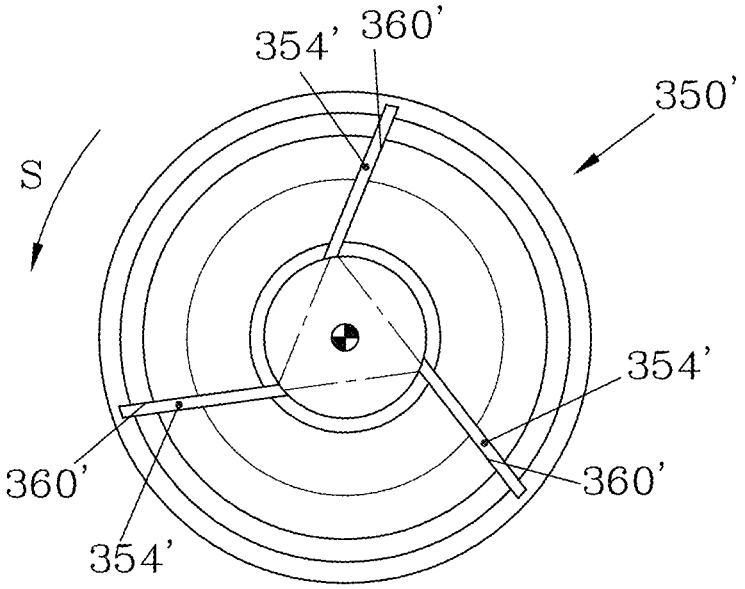

FIG. 10 illustrates a bullet 350 having petals 352 that are separated by notches 354 that do not extend radially straight outwards. Instead, the notches 354 extend at an angle such that projections 356 of the notches 354 do not intersect a central longitudinal axis 358 of the bullet 350. The angle of the notches 354 results in a non-symmetrical cross-section of the petals 352, altering their action after spreading as they are driven through the target by the rotational energy of the bullet 350. The angle as shown in FIG. 10 results in more sharply-angled leading side edges 360 of the petals 352 as they rotate through the target (as indicated by the arrow S, resulting from firing the bullet 350 through a barrel with right-hand twist rifling). In contrast, FIG. 11 shows a bullet 350' where the notches 354' are angled so as to form more blunt leading side edges 360'. The use of more blunt leading side edges 360' may be particularly advantageous for bullets fired from a barrel having a fast twist rate, as such bullets have more rotational kinetic energy and the more blunt leading edges may aid in transferring the rotational kinetic energy of the bullet to the target.

Figure 12:
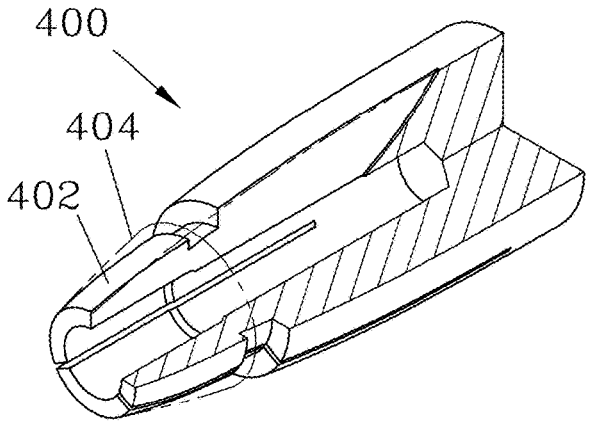
FIGS. 12-18 are partially sectioned views showing further possible configurations of bullets that could be employed, and which have pressure-reducing sections that reduce the inwards pressure compared to bullets having a conventional ogive profile.

Additional possible bullet profiles are shown in FIGS. 12-18. FIG. 12 illustrates a bullet 400 having a pressure-reducing section 402 that has an ogive taper, but which is sharper than the taper of a conventional bullet such as the bullet 100 shown in FIGS. 1-3F, as indicated by the outline 404. Since the pressure-reducing section 402 still has a degree of tapering, it may still experience significant inwards forces, although reduced compared to the forces on the bullet 100. Preliminary testing suggests that, as the degree of pressure reduction increases, the speed at which the bullet will reliably expand also increases, and thus a bullet profile can be selected for a particular chambering, speed, bullet weight, and firearm type. With respect to the latter, the bullet configuration may be selected to suit a particular twist rate and/or a particular action (semi-automatic and fully-automatic firearms may have limits on the profile geometry that are needed to assure reliable feeding). The composition of the bullet may also affect the configuration that will be best suited for a particular use. In addition to varying the exterior profile, the profile of the cavity and/or the angle at which the groove closes to block further bending of the petal forward section may be adjusted to optimize performance for a particular use.

Figure 13:
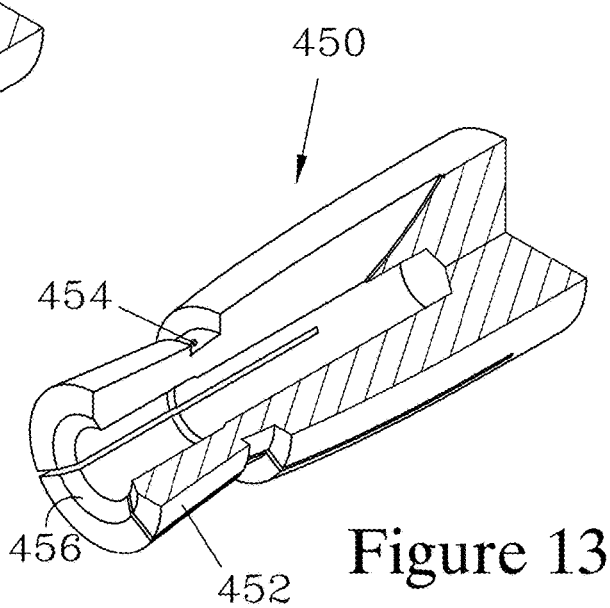
Figure 14:
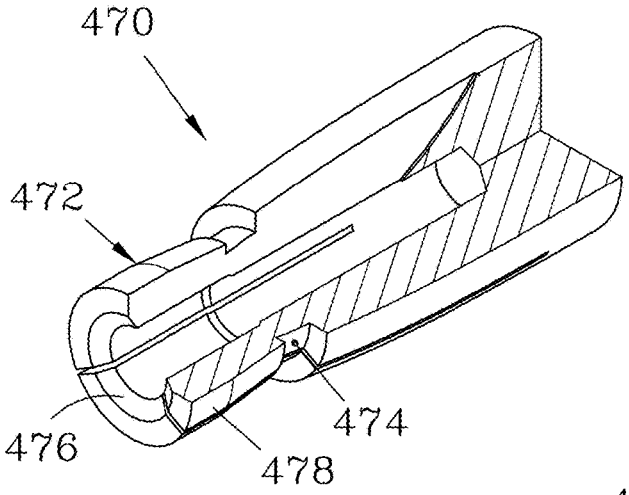
Figure 15:
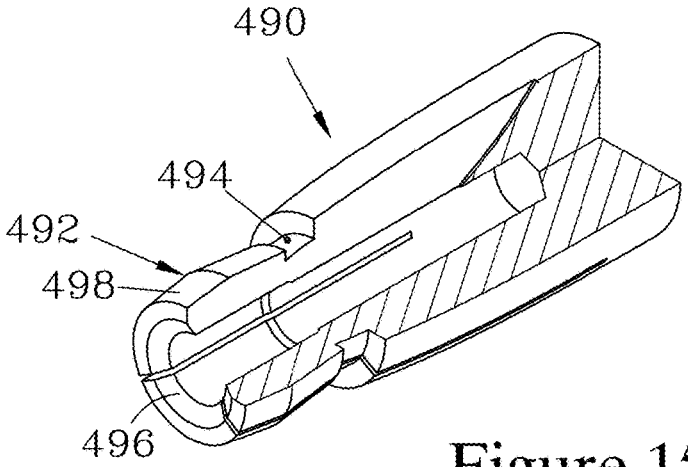

FIGS. 13-15 illustrate bullets (450, 470, 490) that each have a pressure-reducing section (452, 472, 492) that is formed with a reverse taper, such that the diameter increases moving forward from a groove (454, 474, 494). These bullets (450, 470, 490) are also formed with a leading face inner region (456, 476, 496) that slopes rearward to form a funnel. The bullet 470 has a cylindrical region 478, while the bullet 490 has a frustoconical region 498.

Figure 16:
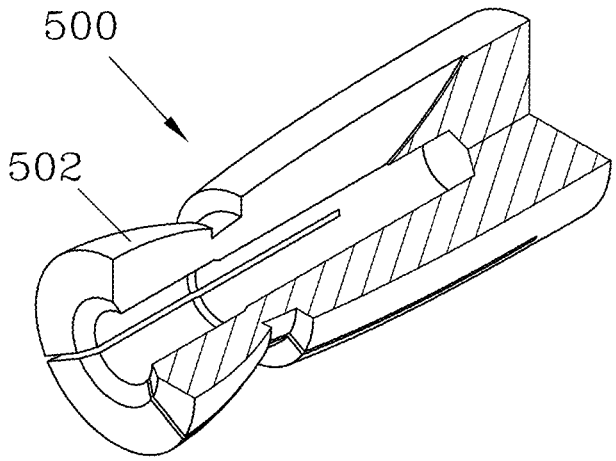
Figure 17:
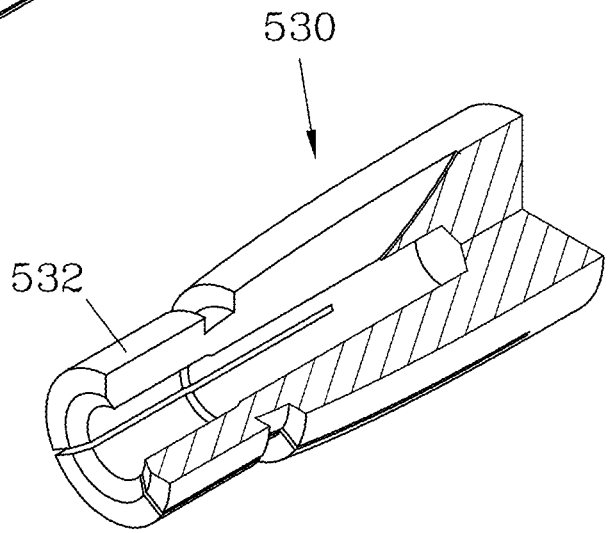
Figure 18:
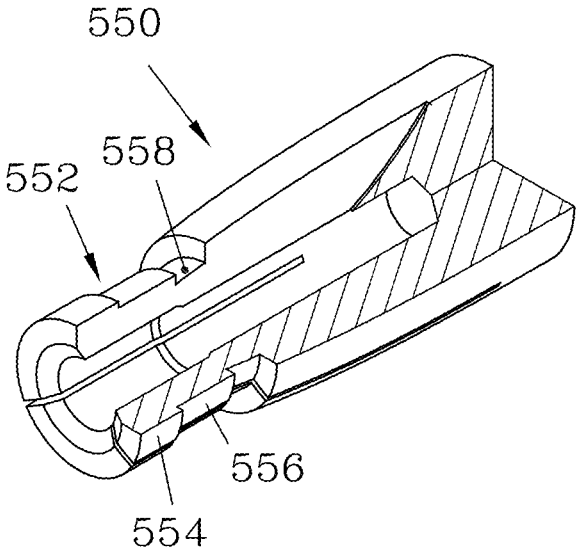

FIG. 16 illustrated a bullet 500 having a pressure-reducing section 502 formed with a reverse ogive profile. FIG. 17 illustrates a bullet 530 having a pressure-reducing section 532 with a straight cylindrical profile, while FIG. 18 illustrates a bullet 550 having a stepped-cylindrical profile of its pressure-reducing section 552, the pressure-reducing section 552 having a forward cylindrical section 554 with a larger diameter than a rear cylindrical section 556 that terminates at a groove 558.

Additional variations in the overall shape and relative proportions of the bullet, the configuration and number of notches, profile of the cavity, exterior profile of the pressure-reducing section (when provided), location and configuration of the groove, etc. may be adjusted to suit particular bullet sizes, intended cartridge chamberings, and intended uses. Additionally, while testing to date has employed solid bullets formed from a single material, the use of composite construction, such as lead regions contained within a copper body, may be found optimal for some situations.

While the novel features have been described in terms of particular embodiments and preferred applications, it should be appreciated by one skilled in the art that substitution of materials and modification of details can be made without departing from the spirit of the invention.

The invention claimed is:

1. A bullet comprising:

an elongated body having a body leading region, with a leading face and a leading region exterior surface, and having a body trailing region, said body being symmetrically disposed about a longitudinal central axis;

a cavity formed in said body leading region, said cavity terminating at said leading face and extending therefrom towards said body trailing region;

a plurality of longitudinal notches extending radially outward from said cavity, said notches dividing at least a portion of said body leading region into a plurality of petals separated from each other by said notches; and a groove in said leading region exterior surface and traversing each petal so as to divide said petal between a petal forward section, extending from said groove to said forward face, and a petal base section extending rearward from said groove, said petal forward section having a petal forward inner surface that defines a portion of said cavity, said groove being configured to act as a living hinge that allows said petal forward section to bend relative to said petal base section under hydraulic forces, but which arrests such bending when said petal forward inner surface reaches a specified angle Θ with respect to the longitudinal axis, wherein said forward region exterior surface has a pressure-reducing section extending forward from said groove, said pressure-reducing section acting to reduce pressure in a region surrounding at least a portion of said petal forward sections that extend forward from said groove, and wherein said forward region exterior surface rearward of said groove has an ogive profile, and said pressure-reducing section has a profile that is discontinuous compared to an extension of said ogive profile.

2. The bullet of claim 1 wherein said pressure-reducing section has at least a portion that is cylindrical.

3. The bullet of claim 1 wherein said leading face further comprises:

a rearward-sloping surface forming a funnel-shape terminating at said cavity.

4. The bullet claim 1 wherein each of said notches extends between said cavity and said forward region exterior surface.

5. The bullet claim 1 wherein each of said notches is radially oriented, such that a projection of said notch intersects the longitudinal axis.

6. The bullet claim 1 wherein each of said notches is angled with respect to a radial orientation when viewed looking toward said leading face, such that a projection of said notch does not intersect the longitudinal axis.

7. The bullet of claim 1 wherein said groove is configured to act as a living hinge that allows said petal forward section to bend relative to said petal base section under hydraulic forces, but which arrests such bending when said petal forward section rear edge is brought into contact with another surface of said groove.

8. The bullet of claim 1 wherein said groove is positioned closer to said leading face than to an end of said body trailing region, as measured along the longitudinal central axis.

9. The bullet of claim 8 wherein said groove is positioned closer to said leading face than to a midpoint between said leading face and the end of said body trailing region, as measured along the longitudinal central axis.

10. A bullet comprising:

an elongated body having a body leading region, with a leading face and a leading region exterior surface, and having a body trailing region, said body being symmetrically disposed about a longitudinal central axis;

a cavity formed in said body leading region, said cavity terminating at said leading face and extending therefrom towards said body trailing region;

a plurality of longitudinal notches extending radially outward from said cavity, said notches dividing at least a portion of said body leading region into a plurality of petals separated from each other by said notches; and a groove in said leading region exterior surface and traversing each petal so as to divide said petal between a petal forward section, extending from said groove to said forward face, and a petal base section extending rearward from said groove, said petal forward section having a petal forward inner surface that defines a portion of said cavity, said groove being configured to act as a living hinge that allows said petal forward section to bend relative to said petal base section under hydraulic forces, but which arrests such bending when said petal forward inner surface reaches a specified angle Θ with respect to the longitudinal axis, wherein said forward region exterior surface has a pressure-reducing section extending forward from said groove, said pressure-reducing section acting to reduce pressure in a region surrounding at least a portion of said petal forward sections that extend forward from said groove, and wherein said pressure-reducing section has a pressure section front diameter $D_F$ and a pressure section rear diameter $D_R$ where the pressure-reducing section terminates at the groove, with these diameters ($D_F$, $D_R$) selected such that $D_F > D_R$.

11. A bullet comprising:

an elongated body having a body leading region, with a leading face and a leading region exterior surface, and having a body trailing region, said body being symmetrically disposed about a longitudinal central axis;

a cavity formed in said body leading region, said cavity terminating at said leading face and extending therefrom towards said body trailing region;

a plurality of longitudinal notches extending radially outward from said cavity, said notches dividing at least a portion of said body leading region into a plurality of petals separated from each other by said notches; and a groove in said leading region exterior surface and traversing each petal so as to divide said petal between a petal forward section, extending from said groove to said forward face, and a petal base section extending rearward from said groove, said groove intersecting said forward region exterior surface along a petal forward section rear edge on said petal forward section, said groove being configured to act as a living hinge that allows said petal forward section to bend relative to said petal base section under hydraulic forces, but which arrests such bending at a predetermined angle when such bending brings said petal forward section rear edge into contact with another surface of said groove, wherein said forward region exterior surface has a pressure-reducing section extending forward from said groove, said pressure-reducing section acting to reduce pressure in a region surrounding at least a portion of said petal forward sections that extend forward from said groove, and wherein said forward region exterior surface rearward of said groove has an ogive profile, and said pressure-reducing section has a profile that is discontinuous compared to an extension of said ogive profile.

12. The bullet of claim 11 wherein said pressure-reducing section has at least a portion that is cylindrical wherein $D_F = D_R$.

13. The bullet of claim 11 wherein said leading face further comprises:

a rearward-sloping surface forming a funnel-shape terminating at said cavity.

14. The bullet of claim 11 wherein each of said notches extends between said cavity and said forward region exterior surface.

15. The bullet of claim 11 wherein each of said notches is radially oriented, such that a projection of said notch intersects the longitudinal axis.

16. The bullet of claim 11 wherein each of said notches is angled with respect to a radial orientation when viewed looking toward said leading face, such that a projection of said notch does not intersect the longitudinal axis.

17. The bullet of claim 11 wherein said groove is positioned closer to said leading face than to an end of said body trailing region, as measured along the longitudinal central axis.

18. The bullet of claim 17 wherein said groove is positioned closer to said leading face than to a midpoint between said leading face and the end of said body trailing region, as measured along the longitudinal central axis.

19. A bullet comprising:

an elongated body having a body leading region, with a leading face and a leading region exterior surface, and having a body trailing region, said body being symmetrically disposed about a longitudinal central axis;

a cavity formed in said body leading region, said cavity terminating at said leading face and extending therefrom towards said body trailing region;

a plurality of longitudinal notches extending radially outward from said cavity, said notches dividing at least a portion of said body leading region into a plurality of petals separated from each other by said notches; and a groove in said leading region exterior surface and traversing each petal so as to divide said petal between a petal forward section, extending from said groove to said forward face, and a petal base section extending rearward from said groove, said groove intersecting said forward region exterior surface along a petal forward section rear edge on said petal forward section, said groove being configured to act as a living hinge that allows said petal forward section to bend relative to said petal base section under hydraulic forces, but which arrests such bending at a predetermined angle when such bending brings said petal forward section rear edge into contact with another surface of said groove, wherein said forward region exterior surface has a pressure-reducing section extending forward from said groove, said pressure-reducing section acting to reduce pressure in a region surrounding at least a portion of said petal forward sections that extend forward from said groove, and wherein said pressure-reducing section has a pressure section front diameter $D_F$ and a pressure section rear diameter $D_R$ where the pressure-reducing section terminates at the groove, with these diameters ($D_F$, $D_R$) selected such that $D_F > D_R$.

* * * * *